US005406671A

United States Patent [19]

Green

[11] Patent Number: 5,406,671

[45] Date of Patent: Apr. 18, 1995

[54] TROWEL

[76] Inventor: Daniel K. Green, 538 E. Lynnwood La., Mesa, Ariz. 85203

[21] Appl. No.: 202,268

[22] Filed: Feb. 25, 1994

[51] Int. Cl.[6] ..... B05C 17/10

[52] U.S. Cl. ..... 15/235.5; 15/235.4; 15/245.1; 15/144.1; 294/3.5

[58] Field of Search ..... 15/235.4, 235.5, 235.6, 15/235.7, 235.8, 143.1, 144.1, 245.1, 236.01; 404/97; 294/3.5, 49; D8/10

[56] References Cited

U.S. PATENT DOCUMENTS

| | | | |
|---|---|---|---|
| 844,204 | 2/1907 | Sohn | 15/235.4 |
| 947,469 | 1/1910 | Gorden | 15/235.5 |
| 1,737,274 | 11/1929 | Sudek, Jr. | 294/3.5 |
| 2,866,327 | 12/1958 | Holmes | 15/235.4 |

FOREIGN PATENT DOCUMENTS

| | | | |
|---|---|---|---|
| 398427 | 7/1924 | Germany | 15/235.4 |

*Primary Examiner*—David A. Scherbel
*Assistant Examiner*—Tony G. Soohoo
*Attorney, Agent, or Firm*—John D. Lister

[57] ABSTRACT

A trowel comprises a flat, elongated rectangular blade having lateral edges and end edges. A pair of handles are pivotally mounted on the rectangular blade along the longitudinal centerline of the blade and adjacent each end of the blade. Each handle can pivot through at least 180° from a first position extending substantially perpendicular to the material handling surface of the blade to a second generally opposite position extending substantially perpendicular to the material handling surface of the blade. This enables the laborer, holding the handles in the first position extending upward from the material handling surface of the trowel blade, to scoop up mud, stucco, plaster, mortar or other surfacing material from a pile with the trowel and then, by pivoting the handles from the first position to their opposite position, to apply the surfacing material directly to the wall being surfaced.

7 Claims, 2 Drawing Sheets

TROWEL

BACKGROUND OF THE INVENTION

The present invention is directed to a trowel and, in particular, to an improved trowel with pivoting handles that enables mud, stucco, plaster, mortar or other surfacing material to be rapidly and efficiently applied to a wall structure.

In the application of mud, plaster, stucco, mortar and other surfacing materials to walls, cinder block fences and the like, the surfacing material is presently scooped up from a pile of the surfacing material with a conventional trowel and deposited on a hawk. About three trowels of surfacing material will typically fill the material holding surface of the hawk. The laborer, holding the hawk in one hand and the trowel in the other hand, then proceeds to scoop the surfacing material from the hawk with the trowel and apply the surfacing material to the wall structure. Just as it typically takes about three trowels of material to load the hawk, it typically takes three trowels of material to transfer the surfacing material from the hawk to the wall structure. The laborer than returns to the pile of surfacing material to reload the hawk and the above described process is repeated.

The above described process for applying surfacing materials to wall structures involves a number of separate steps and is time consuming. Accordingly, there has been a need to simplify the application process and reduce the time required to complete a particular job.

SUMMARY OF THE INVENTION

The trowel of the present invention is simple in construction, durable and provides a tool which can be used to apply surfacing materials to wall structures with ease and a minimum of skill. The towel of the present invention typically can carry up to twice the amount of surfacing material that can be carried on a hawk and since the surfacing material is scooped up onto the trowel and then applied directly to the wall structure, the trowel of the present invention eliminates most of the steps required by the surface material application methods presently used. Thus, the trowel of the present invention provides a simple, easy, efficient tool for rapidly applying surfacing materials to wall structures. The trowel of the present invention is especially effective for rapidly applying surfacing materials to large areas of wall structure.

The trowel of the present invention comprises a flat, elongated, rectangular blade having lateral and end edges and a pair of handles. The handles are pivotally mounted on the longitudinal centerline of the trowel blade adjacent the end edges of the trowel blade. The handles can be pivoted from a first surfacing material loading position where the handles extend outwardly from and are substantially perpendicular to a surfacing material handling surface of the trowel blade to a second position where the handles extend in the generally opposite direction from the first position, outwardly from the backside of the trowel blade and substantially perpendicular to the trowel blade or preferably, at an acute angle to the trowel blade whereby the handles extend generally toward each other such that the longitudinal centerlines of the handles would intersect if extended beyond the free ends of the handles.

Thus, the laborer, in one substantially continuous motion, can scoop up surfacing material from a pile of surfacing material onto the material handling surface of the trowel by holding the handles in the material loading position and then, pivot the handles to the material application position whereby the laborer is ready to apply the surfacing material to the wall structure.

DESCRIPTION OF THE PREFERRED EMBODIMENTS

Figure 2:
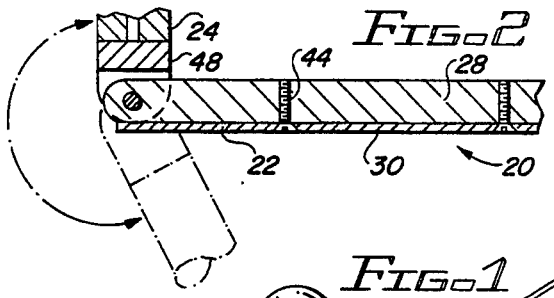
FIG. 2 is a partial sectional view of the trowel taken substantially along lines 2—2 of FIG. 1 to show the pivotal mounting of one of the trowel handles on the trowel blade.

FIGS. 1-5 illustrate the trowel 20 of the present invention in detail. The trowel comprises a flat, elongated rectangular blade 22, handles 24 and 26 and a reinforcing rib 28. The trowel is used to spread mud, stucco, plaster, mortar or similar pasty coating or surfacing materials on wall structures where the materials harden to form a surface on the wall.

The elongated, rectangular blade 22 is made of a metal, such as aluminum or stainless steel or a rigid thermoplastic material. In one embodiment the blade is made of a 3/16 of an inch thick sheet of aluminum approximately 10 inches wide by 22 inches long. While the blade may be made of different materials, as set forth above, the blade must be rigid and strong enough to bear the load of the surfacing material without flexing to any substantial degree. The material handling surface 30 must remain essentially planar during the application of the surfacing material so that the wall surface being formed is essentially flat or planar.

Both of the lateral edges 32 and 34 are straight so that either edge can be the trailing edge during the application of the surfacing material and the trowel 20 can be picked up either way without concern as to which edge will be the trailing edge. The end edges 36 and 38 are also preferably straight except for notched out portions 40 and 42 midway between the lateral edges 32 and 34 that permit the handles 24 and 26 to pivot from one side of the trowel to the other side of the trowel during use.

As shown in FIGS. 1–5, the blade 22 is reinforced by a reinforcing rib 28 which is mounted on the backside of the blade. The reinforcing rib extends the length of the blade 22 between the notches 40 and 42 on the longitudinal centerline of the rectangular blade. As shown the reinforcing rib 28 is a metallic bar, made of aluminum or stainless steel, which is secured to the blade by threaded fasteners 44. It is also contemplated that the bar 28 can be welded, riveted or otherwise affixed to the blade 22 or in the case of a molded thermoplastic blade, the rib can be formed integrally with the blade.

The handles 24 and 26 each comprise an elongated generally cylindrical wooden or plastic portion 46 and a metallic yoke portion 48 which is pivotally mounted on the reinforcing rib. The cylindrical wooden or plastic grip portion 46 is bolted or otherwise secured to the yoke 48. The ends of the reinforcing rib or bar 28 are received between the legs 50 and 52 of the yokes 48. A pin, bolt or other fastening means 54 passes through the legs of each yoke 48 and a bore 56 in the reinforcing bar to pivotally mount the handles on the reinforcing bar.

Figure 1:
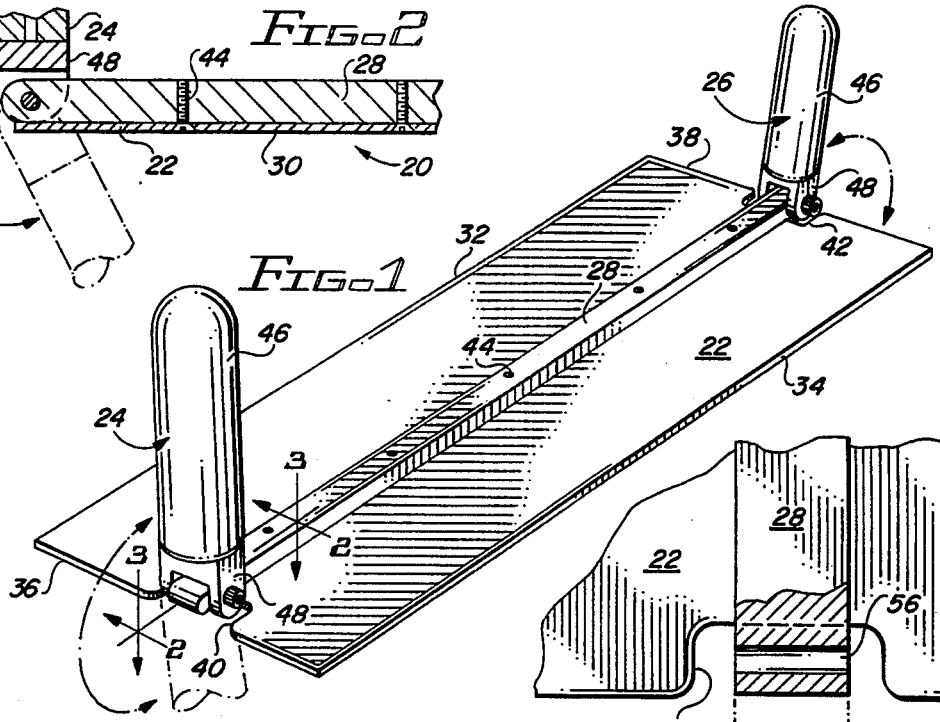
FIG. 1 is a perspective view of the trowel of the present invention.
Figure 3:
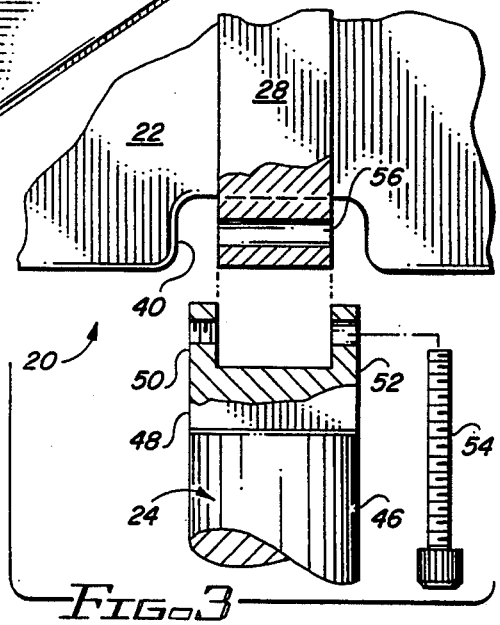
FIG. 3 is an exploded view, partially in section, and taken substantially along lines 3—3 of FIG. 1 to illustrate the pivotal mounting of one of the trowel handles on the trowel blade.
Figure 5:
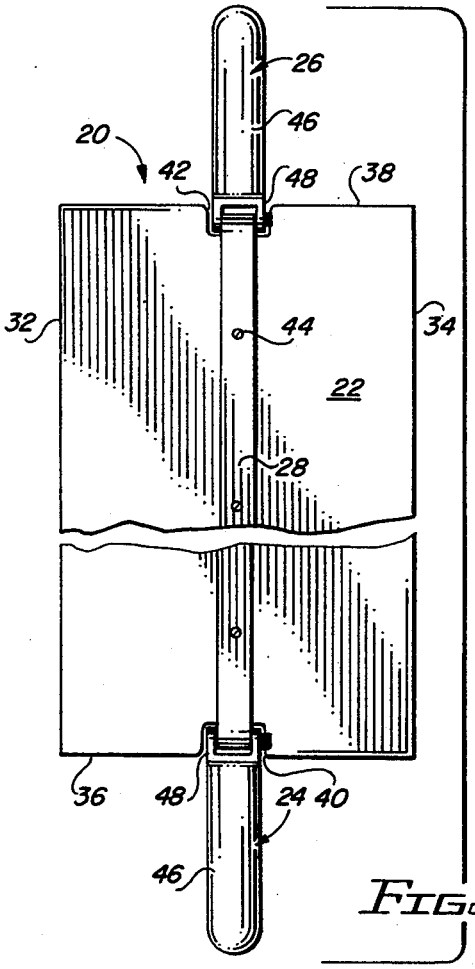
FIG. 5 is a plan view of the trowel of the present invention with the handles substantially midway between the material loading position and the material application position.
Figure 4:
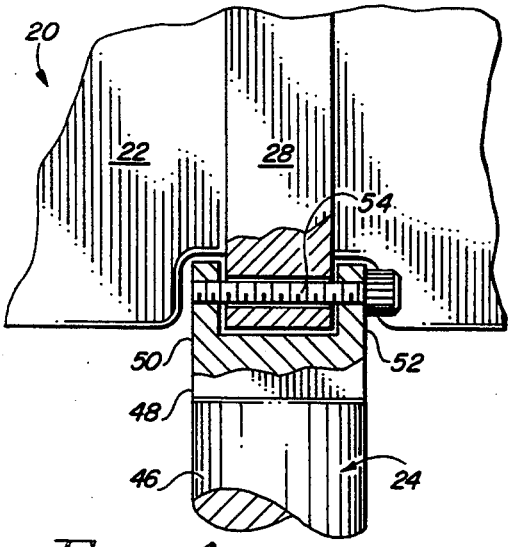
FIG. 4 is a partial section of the pivotal mounting of one of the trowel handles on the trowel blade.

As shown in phantom line in FIGS. 1 and 2, when the handles 24 and 26 are in the surfacing material loading position, the handles extend outwardly from the material handling surface 30 and at an angle ranging from substantially perpendicular to the plane of the blade 22 to an acute angle of about 60° to the plane of the blade. When the handles 24 and 26 are pivoted to the surfacing material application position, the handles extend outwardly from the backside of the blade. In this position, the handles extend at an angle ranging from substantially perpendicular to the plane of the blade (solid line position in FIGS. 1 and 2) to an acute angle of about 60° to the backside of the blade. By pivoting the handles through more than 180° and past a perpendicular position to an acute angle relative to the backside of the blade, the hands of the laborer do not extend as far beyond or may not even extend beyond the end edges 36 and 38 of the trowel when the handles 24 and 26 are in the material application position. Thus, when working in a corner where an adjacent wall extends outwardly from the wall the laborer is surfacing, the hands of the laborer will not scrape against the adjacent wall.

Figure 6A:
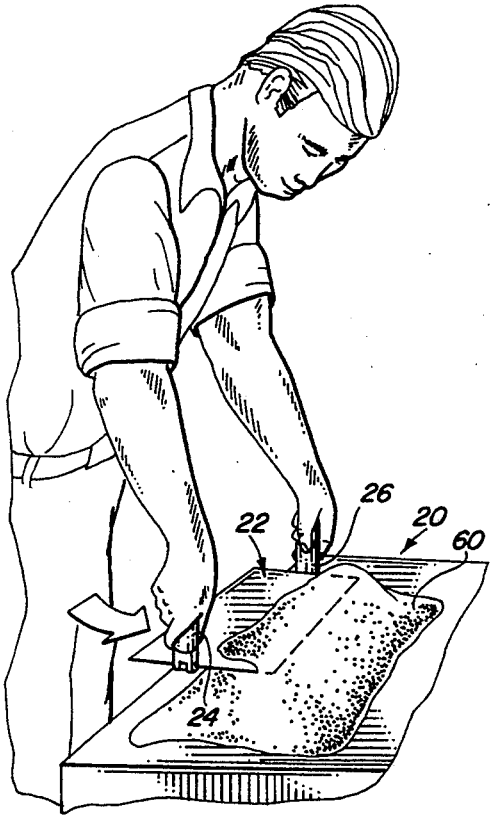
FIG. 6A shows a laborer, holding the handles of the trowel in a material loading position, scooping up surfacing material from a pile.

FIGS. 6A, 6B, 6C, 7, 8 and 9 illustrate the use of the trowel of the present invention. FIG. 6A shows a laborer scooping up surfacing material from a surfacing material pile 60 with the trowel 20. As shown the handles 24 and 26 extend upward from the material handling surface 30 of the trowel blade 22 and substantially perpendicular to the plane of the trowel blade 22.

Figure 6B:
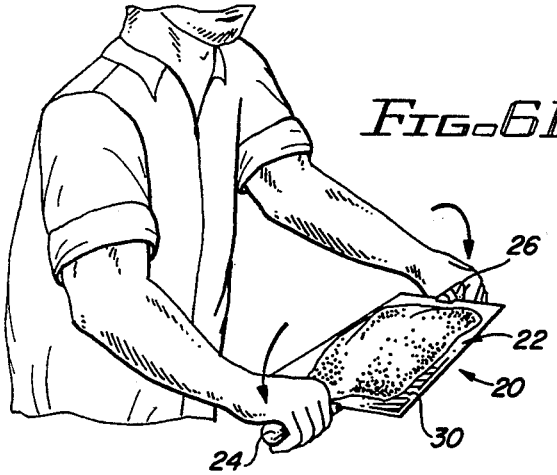
FIG. 6B shows a laborer holding the handles of the trowel in a position intermediate the material loading position and the material application position.
Figure 6C:
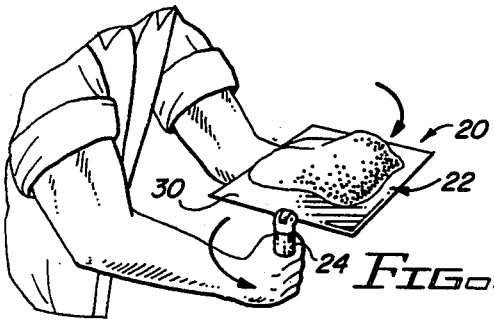
FIG. 6C shows a laborer holding the handles of the trowel in a material application position.
Figure 7:
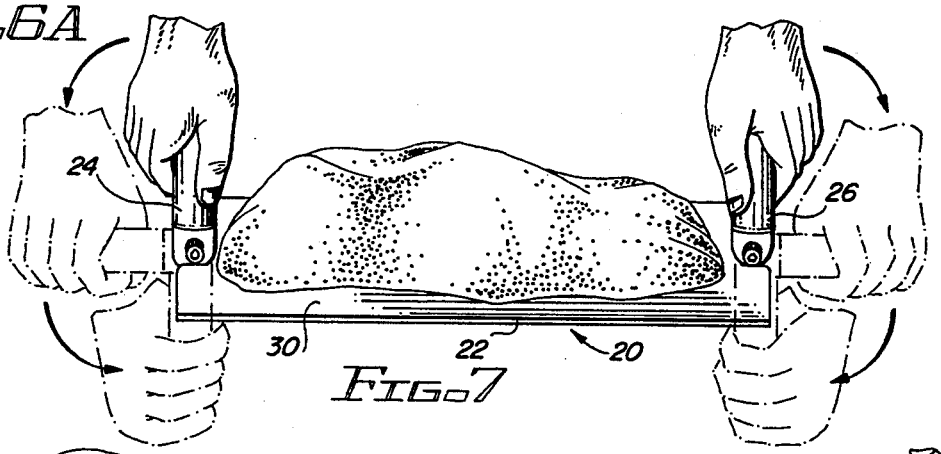
FIG. 7 is a side view of the trowel showing the handles in a material loading position, an intermediate position, and a material application position.

In FIG. 6B, the surfacing material is now being carried on the material handling surface 30 of the trowel blade and the handles 24 and 26 are approximately halfway between the material loading position and the material application position. In FIG. 6C, the handles have each been pivoted through about 180° to about 210° from the perpendicular position shown in FIG. 6A to the material application position. The pivotal movement of the handles 24 and 26 from their surfacing material loading position to their surfacing material application position is further illustrated in FIG. 7.

Figure 8:
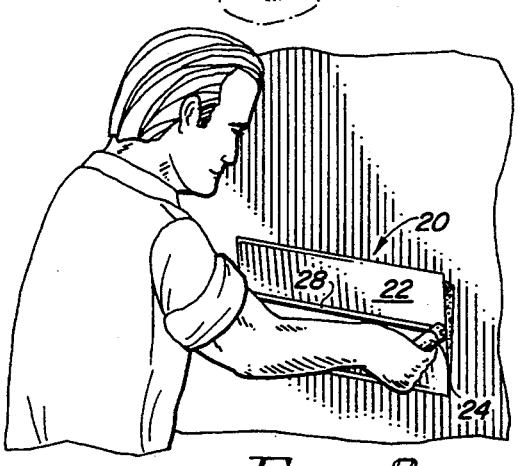
FIG. 8 is a perspective view showing a laborer applying surfacing material to a wall with the trowel of the present invention.
Figure 9:
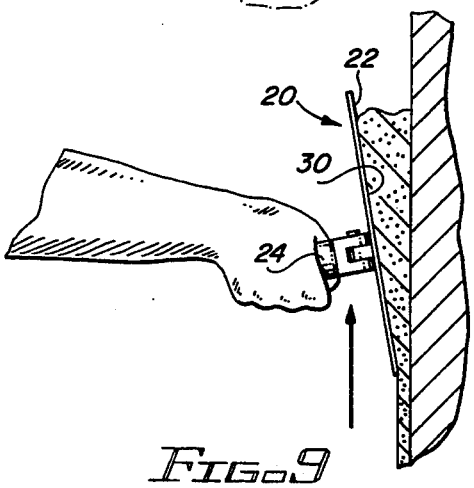
FIG. 9 is a side view showing a laborer applying surfacing material to a wall with the trowel of the present invention.

FIGS. 8 and 9 illustrate the use of the trowel 20 to apply a surfacing material to a wall. As shown, the handles 24 and 26 have been pivoted to the material application position wherein the handles are preferably inclined toward each other so that the hands of the laborer do not extend beyond the end edges 36 and 38 of the trowel.

In another embodiment, where a reinforcing rib is not required to rigidify the trowel blade 22, the handles 24 and 26 are mounted adjacent the end edges of the trowel blade so that the handles can pivot through about 240° to be inclined at an angle of about 60° relative to either of the major planar surfaces of the trowel blade. Thus, in this embodiment, either major surface of the trowel blade can be used as the material handling surface.

In describing the invention certain embodiments have been used to illustrate the invention and the practice thereof. However, the invention is not limited to these specific embodiments as other embodiments and modifications within the spirit of the invention will readily occur to those skilled in the art on reading this specification. Thus, the invention is not intended to be limited to the specific embodiments disclosed, but is to be limited only by the claims appended hereto.

What is claimed is:

1. A trowel comprising:

a flat, rectangular blade having lateral edges and first and second end edges; said rectangular blade having a longitudinal centerline extending between said first and second end edges; said blade having a substantially planar material handling surface;

a first handle; means pivotally mounting said first handle on said rectangular blade substantially on said centerline and adjacent said first end edge to allow said first handle to pivot through 180° about an axis oriented substantially perpendicular to said centerline and parallel to said planar material handling surface of said rectangular blade whereby said first handle can be pivoted from a first position extending substantially perpendicular to said planar material handling surface to a second generally opposite position extending substantially perpendicular to said planar material handling surface; and a second handle; means pivotally mounting said second handle on said rectangular blade substantially on said center line and adjacent said second end edge to allow said second handle to pivot through 180° about an axis oriented substantially perpendicular to said centerline and parallel to said planar material handling surface of said rectangular blade whereby said second handle can be pivoted from a first position extending substantially perpendicular to said planar material handling surface to a second generally opposite position extending substantially perpendicular to said planar material handling surface.

2. The trowel of claim 1, wherein: said rectangular blade is elongated.

3. The trowel of claim 2, wherein: said means for pivotally mounting said first handle on said rectangular blade and said means for pivotally mounting said second handle on said rectangular blade include reinforcing means for reinforcing said rectangular blade.

4. The trowel of claim 3, wherein: said first handle and said second handle can each be pivoted to extend at an acute angle relative to a backside of said rectangular trowel blade.

5. The trowel of claim 1, wherein: said means for pivotally mounting said first handle on said rectangular blade and said means for pivotally mounting said second handle on said rectangular blade include reinforcing means for reinforcing said rectangular blade.

6. The trowel of claim 5, wherein: said first handle and said second handle can each be pivoted to extend at an acute angle relative to a backside of said rectangular trowel blade.

7. The trowel of claim 1, wherein: said first handle and said second handle can each be pivoted to extend at an acute angle relative to a backside of said rectangular trowel blade.

* * * * *